US006044853A

United States Patent [19]

Payzant

[11] Patent Number: 6,044,853

[45] Date of Patent: Apr. 4, 2000

[54] BATCH TYPE DISH WASHING MACHINE WITH FREE FLOATING SPRAY ARM ASSEMBLIES

[75] Inventor: Russell L. Payzant, Olathe, Kans.

[73] Assignee: TCA, Inc., Kansas City, Kans.

[21] Appl. No.: 09/198,897

[22] Filed: Nov. 24, 1998

[51] Int. Cl.[7] ..... A47L 15/23

[52] U.S. Cl. ..... 134/104.1; 134/179; 239/261

[58] Field of Search ..... 134/104.1, 176, 134/179, 180; 239/261, 264

[56] References Cited

U.S. PATENT DOCUMENTS

| | | | |
|---|---|---|---|
| 2,013,387 | 9/1935 | Johnston | 239/261 X |
| 2,954,038 | 9/1960 | Girard | 134/179 X |
| 4,098,455 | 7/1978 | Ammann et al. | 239/264 X |
| 4,175,575 | 11/1979 | Cushing | 134/176 |
| 4,869,428 | 9/1989 | Gombar | 134/179 X |
| 5,725,002 | 3/1998 | Payzant | 134/176 X |

*Primary Examiner*—Philip R. Coe
*Attorney, Agent, or Firm*—Shook, Hardy & Bacon L.L.P.

[57] ABSTRACT

A batch type dish washing machine having spray assemblies supported for rotation on special bearings. Each spray assembly has a spray base through which a pedestal extends to provide a rotational axis. A rotary hub has a bearing compartment which houses a bearing having opposing races and balls located in an annular track between the races. The bearing races are captured between a pair of collars secured to the pedestal by a thumb screw. Water is applied to the dishware by spray arms which extend radially from the hub.

20 Claims, 1 Drawing Sheet

Fig.1.
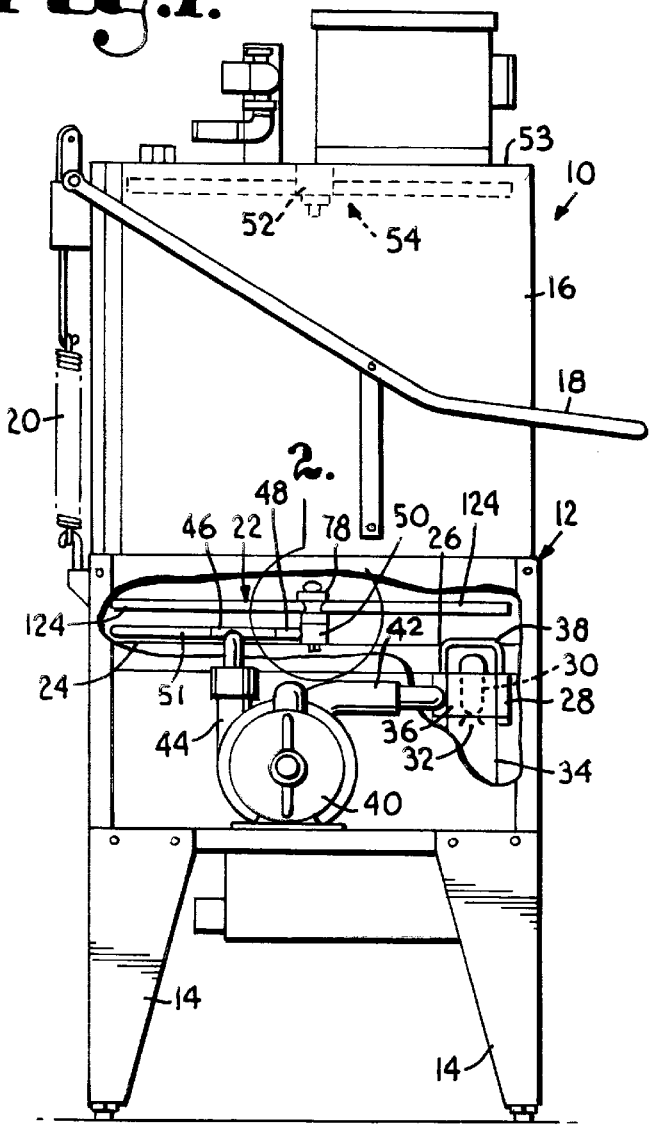
Fig.3.
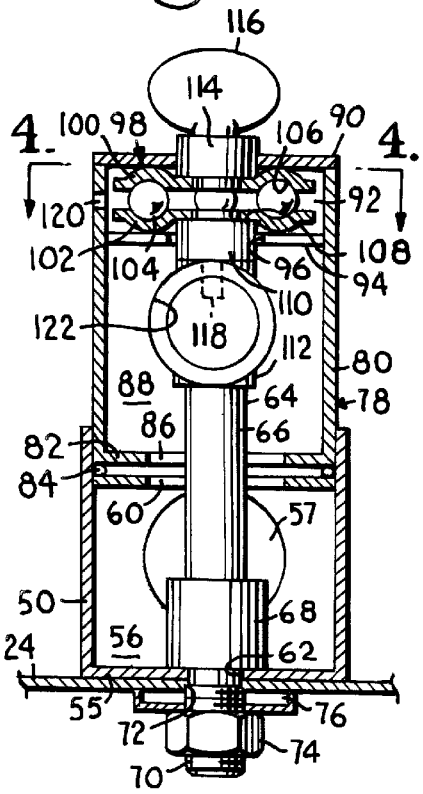
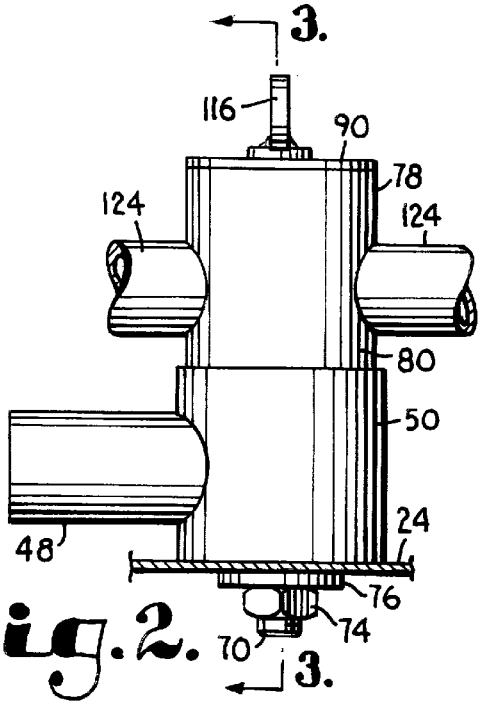
Fig.2.
Fig.4.
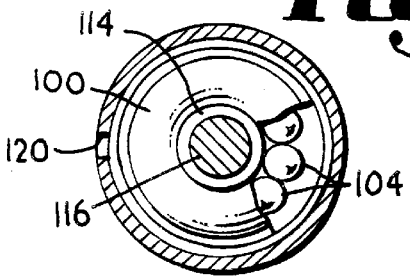

BATCH TYPE DISH WASHING MACHINE WITH FREE FLOATING SPRAY ARM ASSEMBLIES

FIELD OF THE INVENTION

This invention relates generally to dish washing machines and more particularly to a batch type machine that is equipped with an improved bearing for rotatively supporting the spray arm assemblies.

BACKGROUND OF THE INVENTION

Dish washing machines that have commercial and institutional applications are typically either high temperature machines or low temperature machines which are also known as batch machines or dump and fill machines. High temperature machines rely largely on high water temperature for sanitizing the dishware. In comparison, batch machines operate at lower water temperatures and must use chemicals for sanitization.

In both types of machines, food remnants and other debris are inevitably introduced into the wash compartment and can create a variety of problems, including clogging of the spray system and impairment of the bearings which provide rotative support for the spray arms. In order to keep the spray arm assemblies in effective operating condition, the spray arms must be disassembled, cleaned and reassembled during routine maintenance procedures that are carried out periodically. Because the operators of the machines often have somewhat low skill levels, these maintenance operations must be simple. The upper and lower spray units should be interchangeable so that they can be reversed without causing operating problems.

Regardless of how often or how thoroughly the maintenance operations are carried out, it is important to maintain the spray arm bearings free from contamination. Contamination of the bearings with various types of materials can cause them to fail prematurely and can add to the down time of the machine and the overall cost of the equipment.

SUMMARY OF THE INVENTION

The present invention is directed to an improved batch type commercial dish washing machine and has, as its principal object, the provision of a machine having a bearing that provides reliable rotative support for the spray arms while accommodating spray arm interchangeability, quick and easy assembly and disassembly of the spray units, and an extended bearing life.

In accordance with the invention, a spray base for each spray assembly is secured in place by a pedestal which provides a rotational axis for the spray arms. A rotary hub is installed on the pedestal and houses a bearing within a bearing compartment that is formed within the hub. The bearing includes two races which are captured between collars which are secured to the pedestal. The bearing includes ball elements which are located in an annular track formed in confronting faces of the races. One of the races sits on one of the collars, and the hub rests on the other race to support the hub for free rotation. The spray arms extend radially from the hub and apply water to the dishware in the form of a spray that washes and then rinses the dishware.

The upper and lower spray units are constructed the same and can be interchanged. Consequently, even if the spray units become mixed up while disassembled, they can be assembled again in either the upper or lower position without problems. A thumb screw retains each spray assembly in place to facilitate assembly and disassembly. An important feature of the invention is the provision of a discharge port in each bearing compartment which allows water to flow through the bearing to flush away any food debris or other contaminants that could detract from the free rotation provided by the bearing or otherwise degrade the performance of the bearing. The discharge port is larger than the inlet to the bearing.

BRIEF DESCRIPTION OF THE DRAWINGS

In the accompanying drawings which form a part of the specification and are to be read in conjunction therewith and in which like reference numerals are used to indicate like parts in the various views:

FIG. 1 is an elevational view of a dish washing machine equipped with spray assemblies and bearings constructed according to a preferred embodiment of the present invention, with portions broken away and shown in dashed lines for illustrative purposes;

FIG. 2 is a fragmentary elevational view on an enlarged scale showing detail 2 of FIG. 1;

FIG. 3 is a sectional view taken generally along line 3—3 of FIG. 2 in the direction of the arrows; and FIG. 4 is a sectional view taken generally along line 4—4 of FIG. 3 in the direction of the arrows, with a portion broken away for purposes of illustration.

DETAILED DESCRIPTION OF THE INVENTION

Referring now to the drawings in more detail and initially to FIG. 1, numeral 10 generally designates a batch or dump and fill type dish washing machine constructed in accordance with a preferred embodiment of the present invention. The machine 10 has a cabinet 12 which is supported on legs 14. The upper portion of the cabinet 12 provides a wash compartment into which dishware is loaded in racks (not shown). A hood 16 may be lowered to the closed position shown in FIG. 1 to enclose the dishware when the machine is to be operated. A handle 18 operating through a conventional linkage which includes a spring 20 can be operated to raise and lower the hood 16.

A lower spray assembly which is generally identified by numeral 22 is located in the cabinet 12 below the wash compartment which contains the dishware. The lower spray assembly 22 is mounted on a floor panel 24 which is open at 26 immediately above a sump 28. The floor panel 24 may be generally inclined downwardly toward the sump 28 to drain water within the cabinet into the sump.

A drain plug 30 may be closed to close a drain opening 32. When the drain plug 30 is raised to the open position, the drain opening 32 is open so that water in the sump 28 can drain from the sump into a drain pipe 34 leading to the building drain (not shown).

A perforated filter basket 36 is installed in the sump 28 and is provided with a handle 38 which allows it to be lifted out of the sump. A pump 40 mounted in the cabinet 12 has an intake side 42 which connects with the sump 28. The perforated filter basket 36 prevents large food scraps from entering the pump intake 42. As previously indicated, the basket 36 can be removed so that accumulated scrap material can be disposed of.

The pump 40 has a discharge side 44 that connects through the floor panel 24 with a Tee fitting 46. One of the outlet legs of the Tee fitting 46 connects with conduit 48 leading to a spray base 50 forming part of the lower spray assembly 22. The other outlet leg of fitting 46 connects with another conduit 51 forming part of a conduit system that extends upwardly to supply liquid from the pump to an upper spray base 52 which is mounted to a top panel 53 of the machine and which forms part of an upper spray assembly 54 located above the dishware in the wash compartment of the machine. The upper spray assembly 54 is constructed in the same fashion as the lower spray assembly 22 but is inverted relative to the lower spray assembly.

With additional reference to FIGS. 2 and 3 in particular, the spray base 50 takes the form of a cylindrical shell having a flat floor 55 and a hollow interior providing an open chamber 56 (see FIG. 3). The spray base 50 has a side inlet port 57 that connects with the supply line 48 so that water is supplied to the chamber 56. An annular plate 58 is secured in the spray base 50 at a location slightly below its upper end. The plate 58 has a circular opening 60 at its center. The bottom 55 of base 50 has a smaller circular opening 62 formed through its center.

With reference to FIG. 3 in particular, a spindle or pedestal 64 provides a vertical rotational axis for the lower spray assembly 22. The pedestal 64 has a cylindrical shank 66 which extends through the base 50 along its axial center line. The shank 66 also extends centrally through the opening 60 in plate 58. The pedestal 64 includes a cylindrical drum 68 which is connected with the lower portion of the shank 66 and seats on top of the bottom 55 of base 50. The drum 68 provides a projection having a larger diameter than the shank 66. The pedestal 64 has a threaded bottom end 70 which extends closely through opening 62 and through a similarly sized opening 72 formed through the floor panel 24 immediately below opening 62. The lower end 70 of the pedestal receives a nut 74 which may be tightened to secure the pedestal in place on the floor panel 24. A circular seal element 76 is fitted on the threaded lower end portion 70 of the pedestal and is located between the bottom side of panel 24 and the nut 74. When the nut 74 is tightened, the seal element 76 is squeezed against the undersize of panel 24 to provide a water tight seal. Tightening of nut 74 also draws the drum 68 securely against the bottom 55 of base 50 in order to fix the base in place on panel 24.

With continued reference to FIGS. 2 and 3 in particular, a hub which is generally identified by numeral 78 is mounted for rotation on the pedestal 64. The hub 78 has a cylindrical wall 80 which is connected at its lower end to an inwardly projecting flange 82. When the hub 78 is assembled, the flange 82 is spaced slightly above the plate 58 and is sealed to plate 58 by a seal ring 84. The flange 82 has a central opening 86 which is located above opening 60 and is substantially the same size as opening 60. The shank 66 of pedestal 64 extends through opening 86 into the hollow interior 88 formed within the wall 80 of the hub. Wall 80 has a slightly smaller diameter than the wall of the spray base 50 so that the lower portion of wall 80 can fit within the open upper portion of the wall of base 50.

The hub 80 is closed at the top by an annular cover plate 90. A substantially enclosed bearing compartment 92 is formed within the top end of hub 78 within the upper portion of wall 80 and between the cover plate 90 and another annular plate 94 which is spaced below plate 90 and secured at its outer edge to the inside surface of wall 80. Plate 94 provides the lower boundary of the bearing compartment 92 and has a central opening 96 which opens into the hub interior 88.

Located within the bearing compartment 92 is a bearing 98 which includes an upper race 100, a lower race 102, and a plurality of balls 104. The races 100 and 102 are spaced apart and have inside faces which confront one another and cooperate to form an annular track 106 that closely receives the balls 104 between the races 100 and 102.

When the hub 78 is in place on the pedestal 64, the lower race 102 seats on a lip 108 which takes the form of an annular ledge located on the upper surface of a collar 110. The collar 110 is seated on top of a cylindrical barrel 112 which is part of the pedestal 64 and is located on the top portion of shank 66. The collar 110 projects through opening 96. The races 100 and 102 are captured between collar 110 at the bottom and another collar 114 which extends through an opening formed in the cover plate 90 of hub 78. A captive thumb screw 116 extends through openings in the collars 110 and 114 and through openings formed in the races 100 and 102, and the thumb screw 116 is threaded into an internally threaded opening 118 which extends into the top of the barrel 112 on the top end of pedestal 64. When the thumb screw 116 is tightened, the races 100 and 102 are captured between the collars 110 and 114, thus securing the hub 76 above the spray base 50 for rotation about the vertical axis of the pedestal 64. At the same time, the water that is supplied through line 48 to the spray base 50 is able to pass from the spray base chamber 56 into the interior 88 of hub 78.

As shown in FIGS. 3 and 4, a discharge port 120 is formed through the upper portion of wall 80, which is the port of wall 80 that provides the outer boundary for the bearing compartment 92. Consequently, the discharge port 120 accommodates the flow of water from the hub interior 88 through the bearing compartment 92 and out through the discharge port 120, thus allowing the water flow to naturally flush any debris or foreign material that is able to enter the bearing compartment and possibly contaminant the bearing 98. The inlet to the bearing is through opening 96 around the collar 110. This inlet presents a smaller opening than the outlet provided by the discharge port 120.

The wall 80 of hub 78 is provided with a plurality of equally spaced side ports 122 which discharge water from the hub interior 88. A spray arm 124 is threaded or otherwise secured in each of the ports 122. The spray arms 124 extend radially from hub 78 and are provided with conventional spray nozzles that direct water upwardly toward the overlying dishware contained in the wash compartment of cabinet 12. Any suitable number of spray arms 124 can be provided.

With reference to FIG. 1, the upper spray assembly 54 is located above the dishware in the wash compartment of cabinet 12. The upper spray assembly 54 is constructed and assembled in the same manner as the lower spray assembly 22, except that the upper assembly is inverted relative to the lower assembly. Thus, the hub of the upper spray assembly rests with the plate 94 engaging race 102 and the other race 100 resting on the annular lip provided on the confronting face of collar 114. The hub of the upper spray assembly is able to freely rotate due to the construction of the bearing 98 and the manner in which the bearing is arranged relative to the hub and the pedestal which supports the hub for rotation.

When the machine is in operation, the lower hub 78 rests with its cover plate 90 engaging race 100 and the other race 102 resting on the lip 108 provided by collar 110. The hub 78 and spray arms 124 are able to freely rotate about the axis of the pedestal 64 when water is applied to drive the spray assembly in rotational movement.

When the machine 10 is initially operated, incoming water is supplied to fill the sump 28. Detergent and other chemicals may be added, and the pump 40 is then energized to pump water and chemicals to the upper spray assembly 58 and the lower spray assembly 22 such that the spray arms spray wash water and detergent onto the dishware contained within the washing compartment of the machine. At the end of the wash cycle, the drain plug 30 is opened to drain all of the wash water through the drain line 34. The drain plug 30 is then closed, and additional water is supplied to the machine to be used for rinsing. Again, the pump 40 is operated to pump the rinse water out of the sump 28 and to the spray assemblies where it is applied to the dishware by the spray arms.

At the end of the rinse cycle, the dishware may be removed from the machine, and additional dirty dishware may be introduced into the wash compartment. Preferably, the left over rinse water from the preceding cycle is used as the wash water for the next cycle, and the machine then carries out a wash cycle and a rinse cycle in the manner previously described.

In order to disassemble the spray assemblies for maintenance or other purposes, the thumb screw 116 can be unscrewed, and the hub 78 and the connected spray arms 124 can then simply be lifted off of the pedestal 64 (or lowered from the pedestal in the case of the upper spray assembly). The interior regions of the spray base 50 and hub 78 can be cleaned if necessary, and the bearing compartment 92 can likewise be cleaned if necessary. The upper spray assembly 78 can similarly be disassembled and cleaned. To reassemble the lower spray assembly, all that is required is that the hub 78 be applied to the pedestal with the collar 110 in place, and the thumb screw 116 can then be tightened against collar 114 to complete the procedure. The upper spray assembly can be reassembled in a similar fashion.

It is an important feature of the invention that the bearing compartment 92 is flushed of debris when the machine is in operation. A flow path from the chamber 56 through the hub interior 88 and the bearing compartment 92 is established. Consequently, any debris that can possibly contaminate the bearing 98 is flushed away through the port 120.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. In a machine of the type used for washing dishware, a spray assembly comprising:

a spray base on the machine having a hollow chamber for receiving liquid to be applied to the dishware;

a pedestal on the machine extending in said spray base and providing a substantially vertical rotational axis;

a hub having a hollow interior for receiving liquid from said chamber and a plurality of spaced apart ports for discharging the liquid;

a substantially enclosed bearing compartment within said hub;

a bearing in said compartment which includes a pair of spaced apart races having opposing faces presenting an annular track and a plurality of ball elements in said track accommodating relative rotation of said races;

a lip on said pedestal located to receive one of said races in a manner to mount said hub for rotation about said axis with said interior of the hub located to receive liquid from said chamber of the spray base; and a plurality of spray arms on said hub extending generally radially relative to said axis and receiving liquid from said ports to spray onto the dishware.

2. A spray assembly as set forth in claim 1, including a discharge port from said bearing compartment for discharging therefrom liquid which flushes out said bearing compartment.

3. A spray assembly as set forth in claim 1, wherein:

said hub has a substantially cylindrical wall; and said wall provides a side boundary of said bearing compartment.

4. A spray assembly as set forth in claim 3, including a discharge port in said wall for discharging liquid from said bearing compartment used to flush debris from said bearing.

5. A spray assembly as set forth in claim 1, including a pair of spaced apart collars on said pedestal, said lip being presented on one of said collars and said races being captured between said collars at a location within said bearing compartment.

6. A spray assembly as set forth in claim 5, including releasable means for retaining said collars on the pedestal, said releasable means allowing detachment of said hub from said pedestal when released.

7. A spray assembly as set forth in claim 1, including means on said pedestal for securing said spray base in a fixed position on the machine.

8. A spray assembly as set forth in claim 1, including releasable means for securing said pedestal to the machine.

9. A spray assembly as set forth in claim 8, including a projection on said pedestal for securing said spray base in a fixed position on the machine when said releasable means is secured.

10. A spray assembly for a machine for washing dishware, said spray assembly comprising:

a spray base having an open interior chamber for receiving liquid;

a pedestal extending through said spray base, said pedestal providing a substantially vertical rotational axis and having a generally annular lip centered on said axis;

a hollow hub having a plurality of spaced apart ports for discharging liquid received from said chamber, said hub having a substantially enclosed bearing compartment bounded by upper and lower plates;

a bearing located in said bearing compartment;

a pair of spaced apart races included in said bearing, said races having opposing faces presenting an annular track;

a plurality of balls included in said bearing and occupying said track to accommodate relative rotation between said races;

one of said races resting on said lip and the other of said races receiving one of said plates to mount said hub on said pedestal for rotation about said axis with the hub located to receive liquid from said chamber; and a plurality of spray arms extending generally radially from said hub and connected to receive liquid from said ports for spraying onto dishware.

11. A spray assembly as set forth in claim 10, including a discharge port for discharging liquid from said bearing compartment used to flush debris from said bearing.

12. A spray assembly as set forth in claim 10, wherein:

said hub has a substantially cylindrical wall, including a portion of said wall located between said plates; and said portion of said wall provides a side boundary of said bearing compartment.

13. A spray assembly as set forth in claim 12, including a discharge port in said portion of said wall for discharging liquid from said bearing compartment used to flush debris from said bearing.

14. A spray assembly as set forth in claim 10, including a pair of spaced apart collars on said pedestal, said lip being presented on one of said collars and said races being captured between said collars at a location within said bearing compartment.

15. A spray assembly as set forth in claim 14, including releasable means for retaining said collars on the pedestal said releasable means allowing detachment of said hub from said pedestal when released.

16. A spray assembly as set forth in claim 10, including releasable means for securing said pedestal to the machine.

17. A spray assembly for washing dishware, comprising:

a fixed spray base having an open interior chamber for receiving liquid;

a pedestal extending through said spray base for providing a rotational axis, said pedestal having a pair of spaced apart collars;

a hollow hub for receiving liquid from said chamber, said hub having a substantially enclosed bearing compartment located between a pair of plates mounted on the hub;

a bearing in said bearing compartment for mounting said hub on said pedestal for rotation about said axis;

a pair of spaced apart races forming part of said bearing, said races being captured between said collars and between said plates in said bearing compartment;

opposing faces on said races providing an annular track;

a plurality of balls forming parts of the bearing, said balls being located in said track to accommodate rotation of said hub about said axis with the hub located to receive liquid from said chamber; and a plurality of spray arms extending generally radially from said hub for spraying liquid delivered to the hub.

18. A spray assembly as set forth in claim 17, including a discharge port for discharging liquid from said bearing compartment used to flush debris from said bearing.

19. A spray assembly as set forth in claim 17, wherein:

said hub has a substantially cylindrical wall, including a portion of said wall located between said plates; and said portion of said wall provides a side boundary of said bearing compartment.

20. A spray assembly as set forth in claim 19, including a discharge port in said portion of said wall for discharging liquid from said bearing compartment used to flush debris from said bearing.

* * * * *